US005453130A

United States Patent [19]

Maddox

[11] Patent Number: 5,453,130

[45] Date of Patent: Sep. 26, 1995

[54] SYSTEM FOR SEWER LINE PREVENTIVE MAINTENANCE

[76] Inventor: Eric A. Maddox, 6648 E. Nelson Dr., Tucson, Ariz. 85730

[21] Appl. No.: 276,624

[22] Filed: Jul. 18, 1994

[51] Int. Cl.[6] ..... B08B 9/06; B08B 9/02

[52] U.S. Cl. ..... 134/8; 134/18; 134/22.12; 364/400; 364/409; 364/DIG. 1; 364/DIG. 2

[58] Field of Search ..... 134/8, 18, 22.12; 364/400, 409, DIG. 1, DIG. 2; 137/15; 15/104.33

[56] References Cited

U.S. PATENT DOCUMENTS 4,998,208 3/1991 Buhrow et al. ..... 364/512
5,063,505 11/1991 Pate et al. ..... 364/400
5,069,722 12/1991 Murphy ..... 134/22.12
5,172,332 12/1992 Hungerford et al. ..... 364/510

*Primary Examiner*—W. Gary Jones
*Assistant Examiner*—Sean Vincent
*Attorney, Agent, or Firm*—Floyd E. Anderson

[57] ABSTRACT

Preventive maintenance to sewer lines is made more effective by using a predictive knowledge based assessment of those sewer lines most likely needing maintenance. Such predictive methods, are methodically applied to a sewer line system, to provide rodding to those sewer lines in need of maintenance or likely to need maintenance in the near future. Hence, non-problematic sewer lines are identified by default and are not unnecessarily serviced. Sewer lines are identified for preventive maintenance by identifying root intrusion, grease, and grit accumulation sources.

20 Claims, 8 Drawing Sheets

FIG. 5

OPERATORS: _____

TRUCK NO.: _____

| | DATA | PAGE/ GRID | BASE MAP | LOCATION | OBSTRUCTION TYPE | OBSTRUCTION AMOUNT | DISTANCE/ DIRECTION |
|---|---|---|---|---|---|---|---|
| 1 | | | | | | | |
| 2 | | | | | | | |
| 3 | | | | | | | |
| 4 | | | | | | | |
| 5 | | | | | | | |
| 6 | | | | | | | |
| 7 | | | | | | | |
| 8 | | | | | | | |
| 9 | | | | | | | |
| 10 | | | | | | | |
| 11 | | | | | | | |
| 12 | | | | | | | |
| 13 | | | | | | | |
| 14 | | | | | | | |
| 15 | | | | | | | |
| 16 | | | | | | | |
| 17 | | | | | | | |
| 18 | | | | | | | |
| 19 | | | | | | | |
| 20 | | | | | | | |
| 21 | | | | | | | |
| 22 | | | | | | | |
| 23 | | | | | | | |
| 24 | | | | | | | |
| 25 | | | | | | | |

OBSTRUCTION SYMBOLS: ◯ NONE ⊖ MINIMAL/MODERATE ⊗ SUBSTANTIAL

ABBREVIATIONS: E - EUCALYPTUS T - TAMARACK O - OLEADERS G - GREASE

SYSTEM FOR SEWER LINE PREVENTIVE MAINTENANCE

FIELD OF THE INVENTION

The present invention relates generally to sewer line maintenance, and more particularly, to a preventative maintenance system for more efficiently identifying and servicing those identified sewer lines.

BACKGROUND OF THE INVENTION

Wastewater collection systems generally include a plurality of underground pipelines or sewer lines which contain and convey wastewater from property connection lines to treatment facilities. Preventive maintenance is performed in order to keep those pipelines clear by regularly eliminating blockages. In some localities, a high majority of those blockages are caused by root intrusion. Roots can also fracture sewer lines, causing soil and ground water contamination. Sewer line blockage is also commonly caused by grease accumulation. When sewer lines are not kept clear, streets, homes, and businesses can be contaminated with raw sewage.

Currently, preventive maintenance is performed using rodders and/or high pressure cleaners (hereinafter referred to as HPCs). A rodder is preferably used to deal with root intrusion (though a rodder may be used to remove grease also). A rodder consists of a saw/blade attached to rod (metal cables) which are contained within a cage. The saw/blades and rods are fed out of the cage while spinning. The resulting motion cuts and dislodges roots and grease allowing the intrusions to move down the sewer line towards a treatment facility. An HPC is preferably used to remove coagulated grease and grit (particulate matter) from the sewer lines. The HPC pumps water at a high pressure through the sewer lines. This water displaces the grease and grit.

Current preventive maintenance methods vary amongst localities. In many cities, cleaning all sewer lines is required within, for example, a five to seven year time span. Generally, each sewer line segment is cleaned between consecutive manhole/clean-outs with a rodder or HPC. The basis for this inclusive coverage is a presupposition that there is no feasible method to reliably distinguish between those sewer lines requiring service and those sewer lines not requiring service. That is, wastewater departments are unable to determine from ground's surface, via examining wastewater flow through manholes, whether or not a problem does or will exist. Therefore, all sewer lines are cleaned. As might be expected, such inclusive coverage demands extravagant amounts of equipment, manpower and money.

Another popular sewer line maintenance method is known as the wastewater collection management system (WCMS). WCMS is used either separately or in conjunction with the method of cleaning all sewer lines. WCMS uses computers to log and track those locations where problems have occurred, wherein problem locations are assumed to cause eventual stoppages or repeated stoppages. Thus, based upon a database of known problem locations, sewer line maintenance is performed periodically on the problem locations for preventing stoppages from occurring/reoccurring. One problem with WCMS is that sewer lines must cause a problem before being added to the database, and hence a health hazard is permitted and preventive maintenance is not truly accomplished. Additionally, an address reporting a problem may be accidentally logged as the problem area versus the actual problem area be reported (the problem line thereafter being neglected). Still another problem is that sewer lines peripheral to the problem sewer line are serviced in conjunction with the problem sewer line which defeats accuracy and efficiency. WCMS also fails to address those sewer line blockages/problems that are not yet detectable, but at a future date may cause a serious problem. For example, root intrusion may not be detected presently, but may later cause a structural failure to the sewer line resulting in a collapse. While this process may take years, in the interim, a partially fractured line will allow raw sewage to contaminate nearby soil and ground water.

Sewer line maintenance is also performed, in some localities, based only upon reported problems, even though some reported problems are not actually related to the public sewer lines (and not the responsibility of the sewer line maintenance department). This reactionary sewer line maintenance fails to account for a cause and effect relationship between roots/grease and the resulting stoppages/line damage. Stated differently, this method fails to recognize a basic rule of hydrology—water always seeks it's own lowest level. The specific densities of differing liquids and gasses results in a separation such that the most dense will seek the bottom while the least dense will seek the top. While in a contained system, such as a collection system, water always acts the same. Application of this rule is fundamental to determining whether a sewer line problem exists.

For example, a homeowner calls the local public works department with a common complaint; when the commode is flushed, water comes up the shower or floor drain. The public works department sends an emergency crew to the location. Upon arrival, the crew opens the closest upstream manhole to see if water is backed up at the bottom of the manhole. If water is backed up, a partial or complete obstruction exists in the public line and is the cause of the caller's problem. However, if the bottom of the manhole is lower than the lowest drain of the caller's property and no water is backed up at the bottom of the manhole, the problem is not caused by an obstruction in the main line. This is a false alarm. There is nothing the crew can do to relieve the problem. In spite of this fact, they are required to clean the line. This method is costly and yields nothing more than chance interception of roots or grease.

Accordingly it is desired to provide a preventive sewer line maintenance system that accurately identifies only those sewer lines highly likely to cause future blockages if not serviced, and to systematically service those sewer lines.

SUMMARY OF THE INVENTION

An object of the present invention is to provide an improved sewer line preventive maintenance system.

Another object of the present invention is to provide a sewer line preventive maintenance system that reliably identifies those sewer lines most likely to pose future problems.

Yet another object of the present invention is to provide a sewer line preventive maintenance system that minimizes a number of sewer lines serviced while also minimizing a number of reported sewer line blockages.

According to a preferred embodiment of the present invention, a sewer line preventive maintenance method for regularly servicing sewer lines in a given geographical area is described. The preventive maintenance method includes determining sewer line blockage predictors for the geographical area. The geographical area is divided into a plurality of predetermined grids for systematically servicing the sewer lines. Those sewer lines having probable blockages are identified in each grid by using the sewer line blockage predictors. The identified sewer lines in each grid having a sewer line blockage predictor proximate thereto is serviced and, using the information from servicing those sewer lines, a knowledge based preventive maintenance database is built for regularly servicing the identified probable sewer line blockages in geographical area.

The foregoing and other objects, features, and advantages of the invention will be apparent from the following more particular description of a preferred embodiment of the invention, as illustrated in the accompanying drawing.

DESCRIPTION OF THE FIGURES

FIG. 5 is a grid system log in accordance with a preferred embodiment of the present invention.

DETAILED DESCRIPTION

The sewer line preventive maintenance system according to a preferred embodiment of the present invention comprises a grid system based upon predicting which sewer line locations are most susceptible to root intrusion, and grease and grit accumulation prior to servicing. Extremely accurate prediction techniques have proved 100% accurate in a two square-mile test area. Using accurate identification of those sewer lines segments with a propensity for root, grease and grit accumulations allows for interdiction of the causes thereof. Hence, stoppages, over-flows and sewer line damage can be prevented. Consequently, the sewer line preventive maintenance system described herein also identifies those sewer lines that do not need maintenance. Most sewer lines (approximately 90%) do not require preventive maintenance service.

Figure 4A:
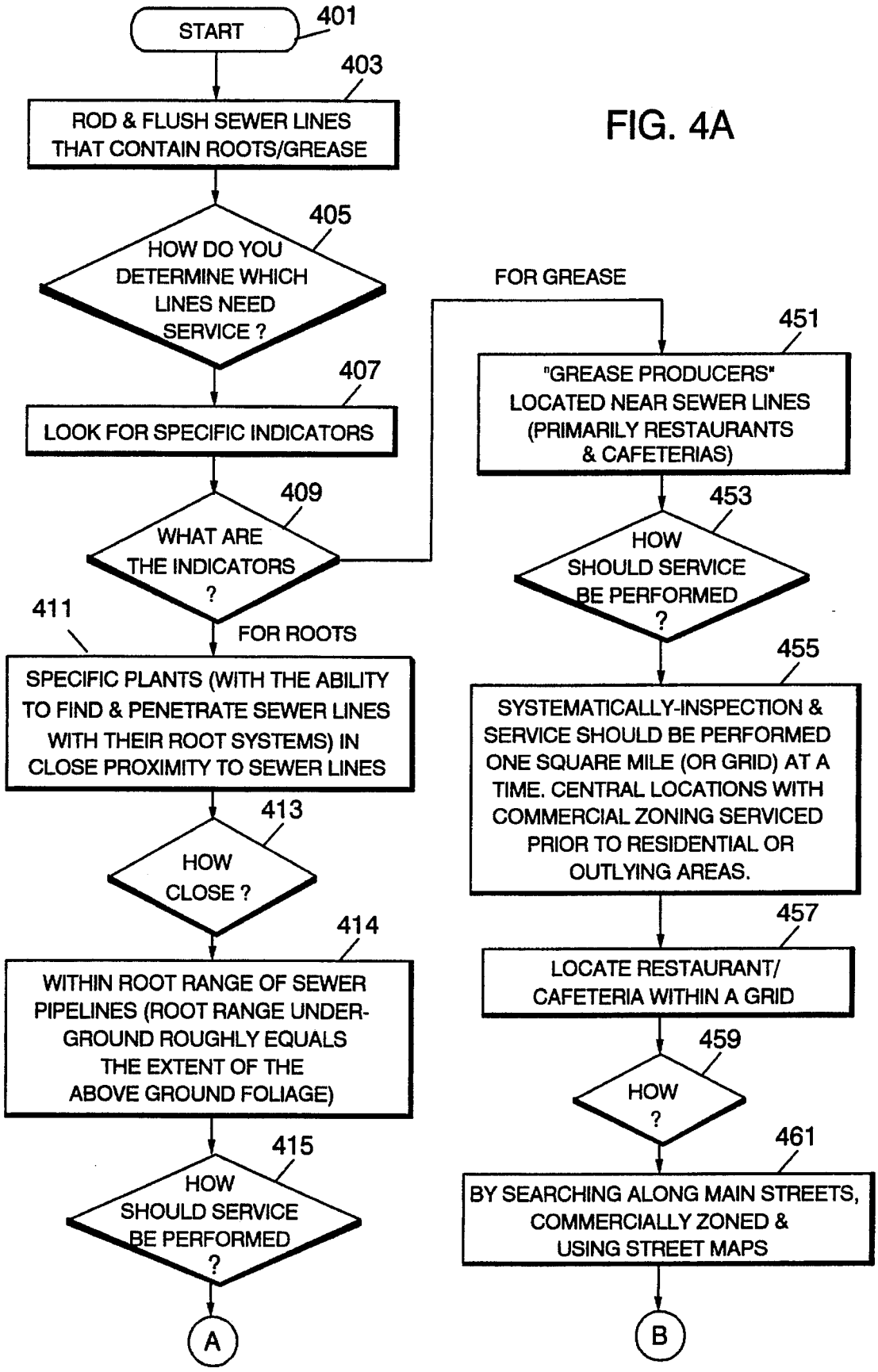
FIGS. 4A and 4B are flow diagrams of a method of sewer line preventive maintenance in accordance with a preferred embodiment of the present invention.
Figures 1, 4B:
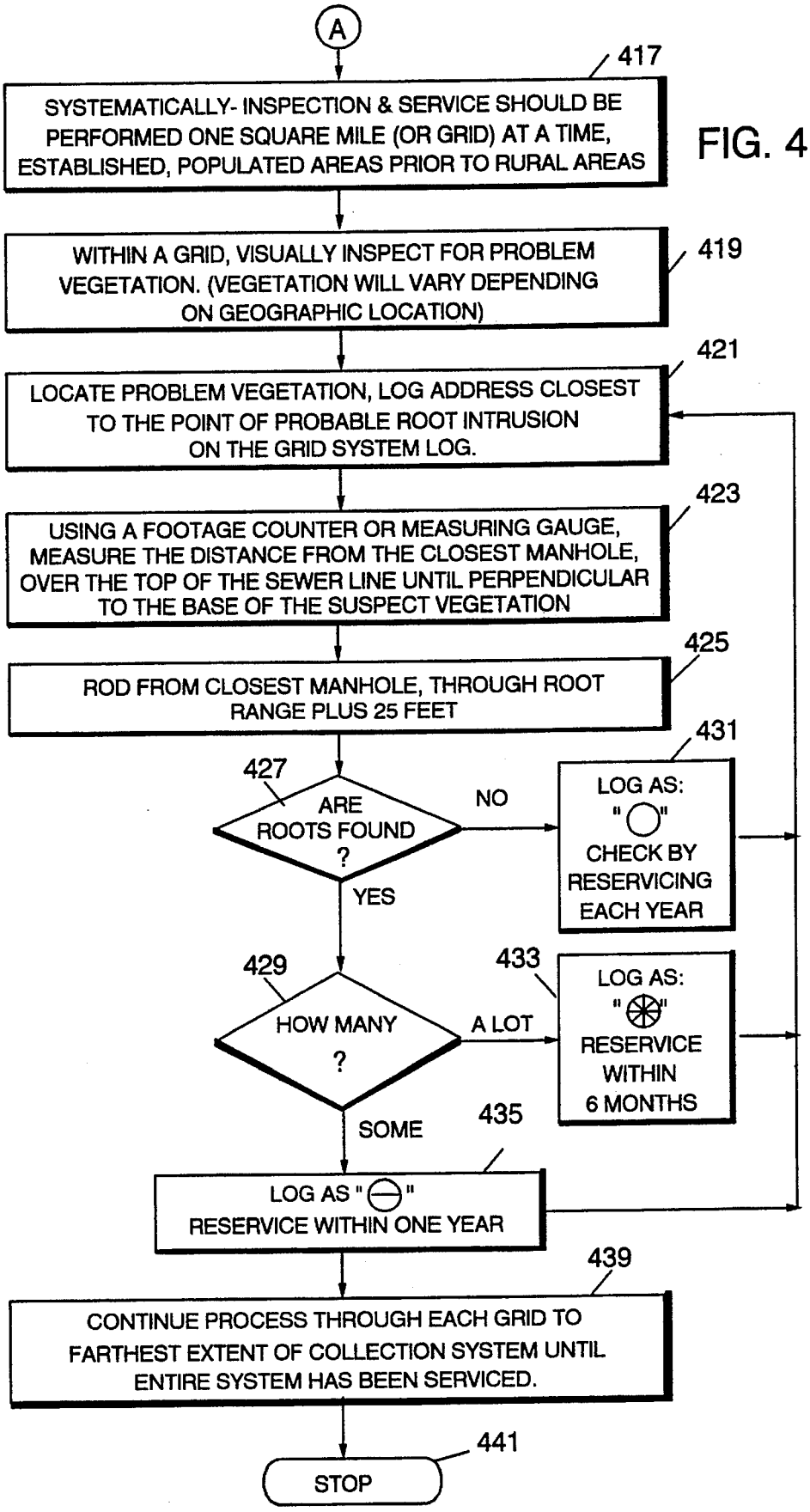
Figures 2, 4B:
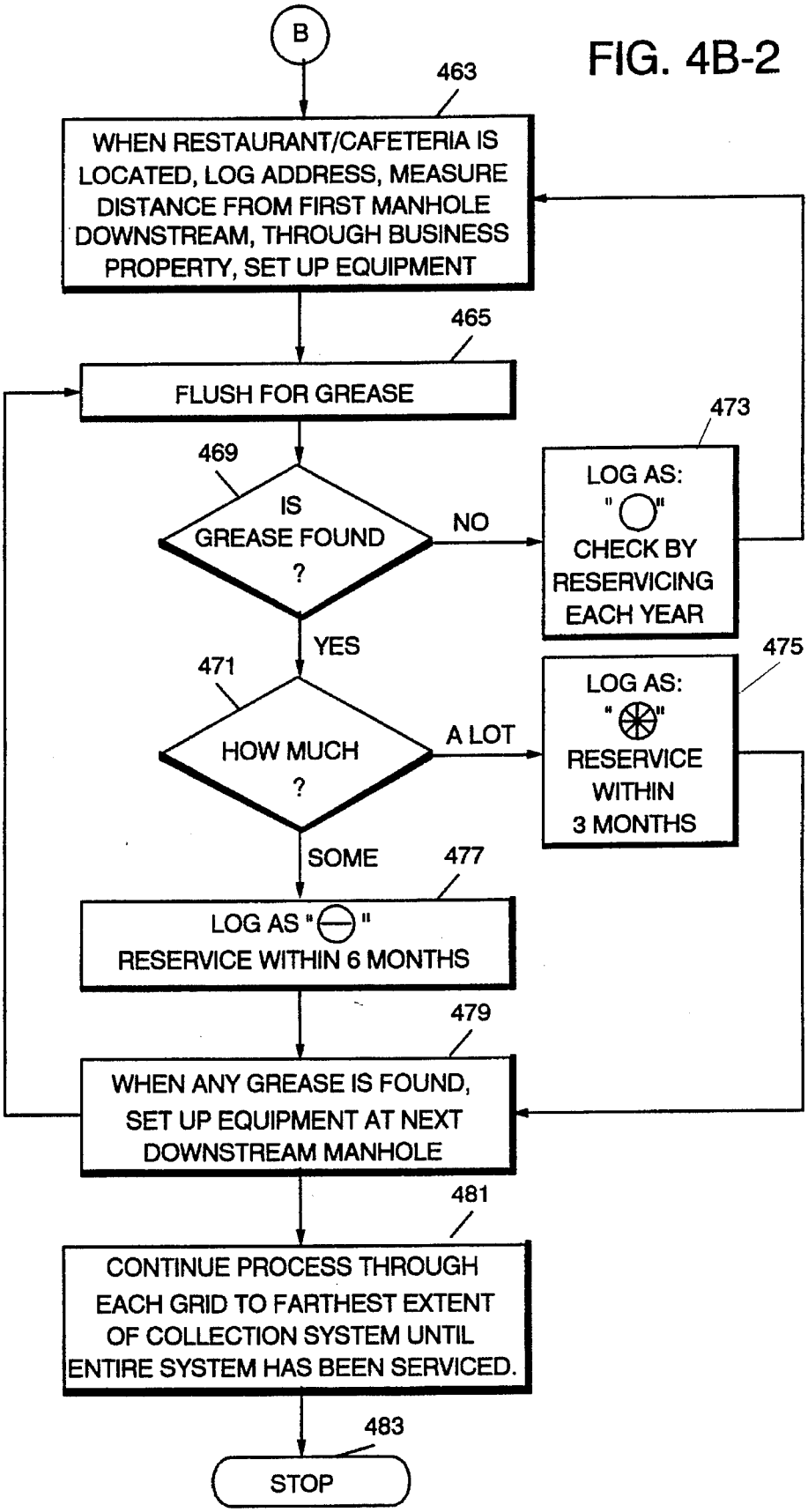

Referring now to FIG. 1, a pictorial diagram illustrates two basic hydraulic power rodders 10 and 20 for cleaning sewer lines. The hydraulic power rodder 10 includes a covered rod cage 13, which contains, for example, a 1,000 foot reel of steel rod therein. The rod cage 13 spins for causing the steel rod to spin. An access panel 13 provides access to drive gears and rollers (not shown). A single control handle 14 operates the hydraulic power rodder 10. The steel rod enters and exits the covered rod cage at end 11.

The hydraulic power rodder 20 has a covered rod cage 21 similarly containing a reel of steel rod. The covered rod cage 21 tumbles to produce a rod spin. An access panel 23 is provided and dual control handles 22 operate the hydraulic power rodder 22. The hydraulic power rodders 10 and 20 can each be truck mounted or towed. An adapter and rod end 30 is shown for illustrating how cutting tools attach to the steel rod. Set screws 32 at one end secure a beveled rod tip 33 for attaching the steel rod to the adapter. The adapter, at an opposite end, has internal threads for attaching a cutting tool thereto. Two cutting tools, saw 40 and blade 50, can attach to the adapter. The saw 40 includes a saw blade 41 made from a spiral steel ribbon having serrated cutting edges, and a threaded sleeve 42 for attaching to the internal threads 31 of the adapter. The blade 50 includes a plurality of blades 51 fitted into a blade cuff, and a threaded sleeve 52 for attaching to the internal threads 31 of the adapter.

Figure 1A:
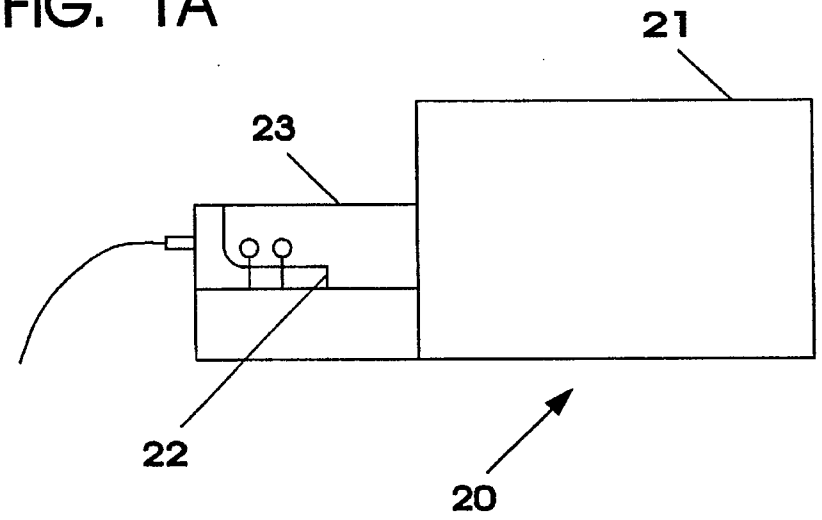
FIG. 1 is a pictorial diagram showing hydraulic power rodders in accordance with a preferred embodiment of the present invention.
Figure 1B:
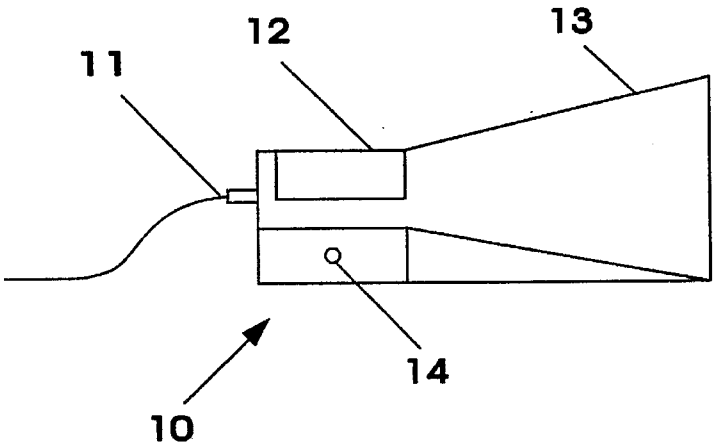
Figure 1B:
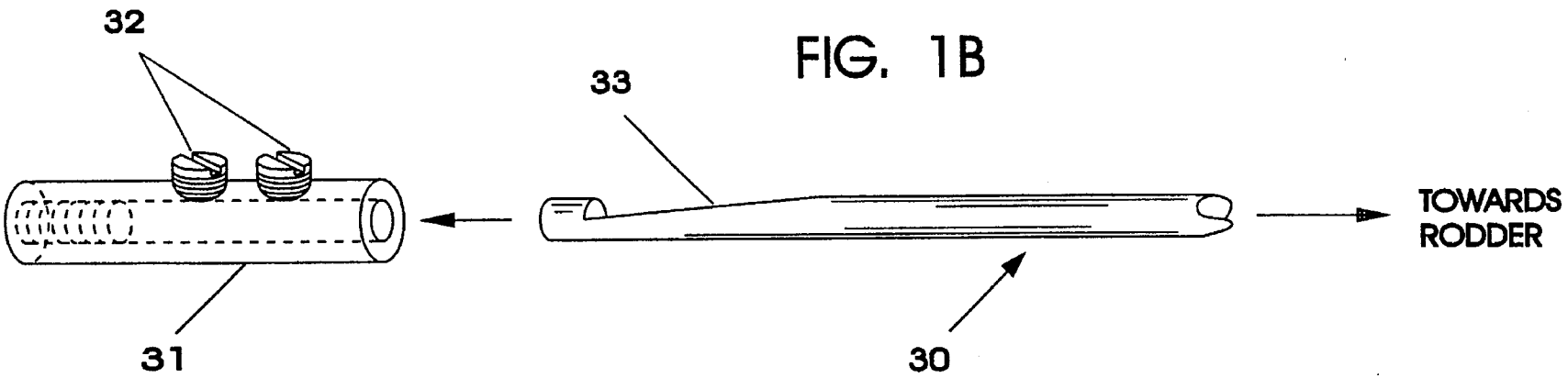
Figure 1D:
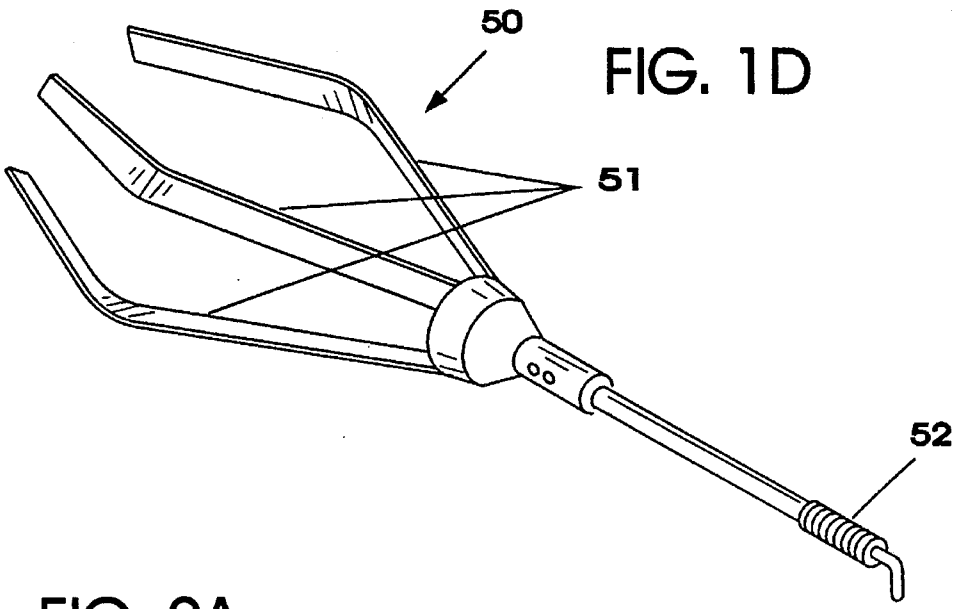
Figure 1C:
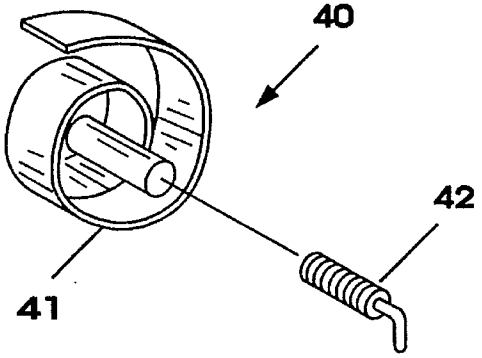
Figure 2A:
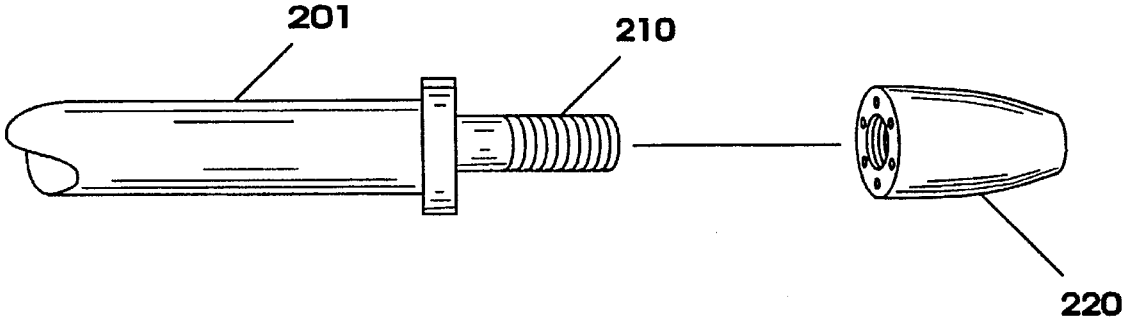
FIG. 2 is a pictorial diagram of high pressure cleaners in accordance with a preferred embodiment of the present invention.
Figure 2:
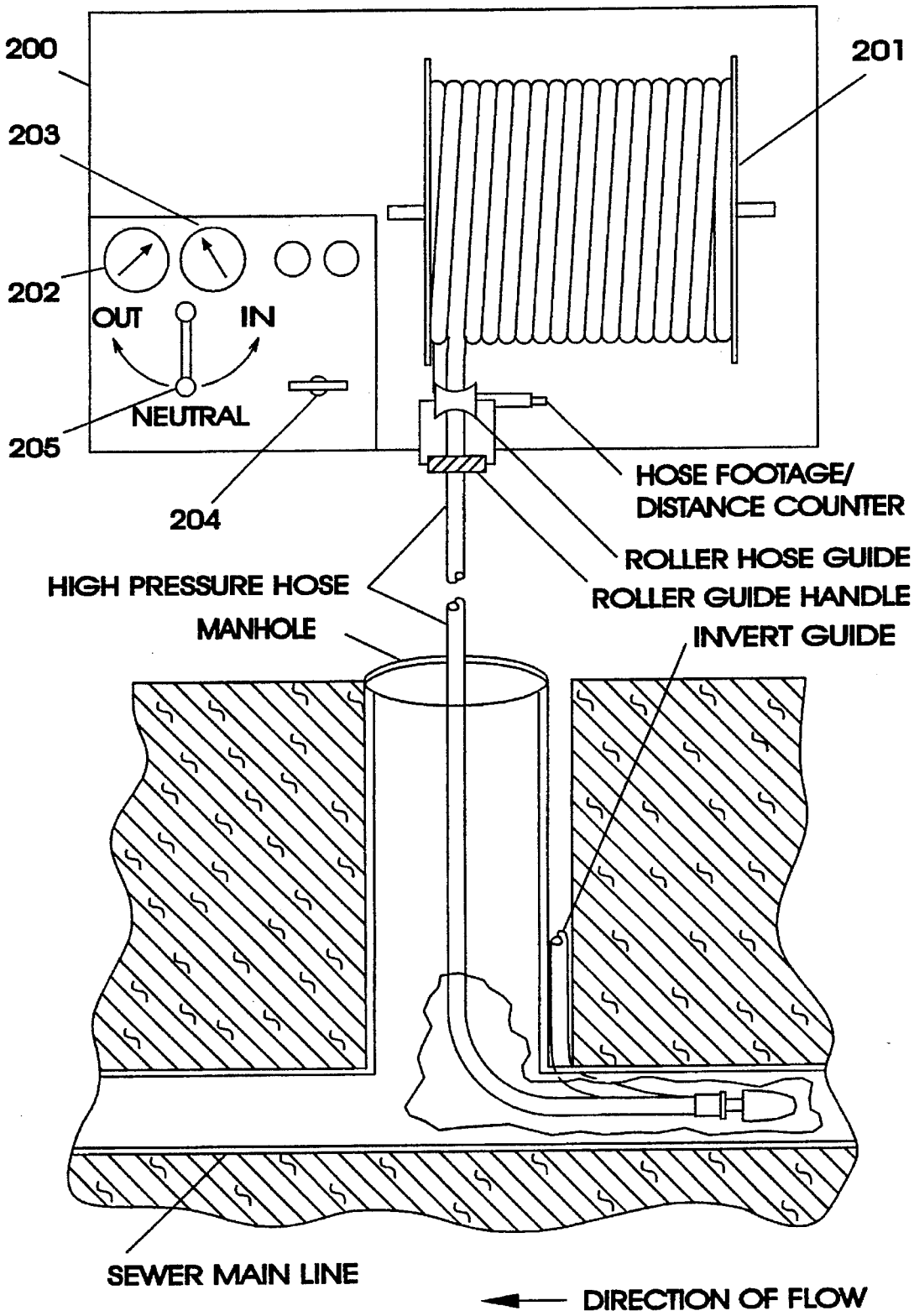

FIG. 2 illustrates a typical high pressure cleaner reel and control panel 200 having, for example, a 500 foot reel of high pressure water hose 201 (hereinafter referred to as water hose 201) wound therein. The water hose 201 can typically handle a pressure of 1800–2100 PSI. A water gauge 202 indicates an amount of water available in a tank and a gauge 204 indicates a pressure of the water. A pump handle 204 controls a water pump and a reel handle 205 controls letting the water hose 201 in and out. The hose 201 includes a threaded end 210 for attaching a high pressure cleaner head 220 thereto. The high pressure cleaner head 220 has reverse jet water orphaces. As illustrated in FIG. 2, the hose 201 is inserted into a manhole using an invert guide and the high pressure cleaner head 220 is directed into a sewer line in a direction opposite the flow of water.

Having described the basic tools for cleaning sewer lines, the present invention is based upon accurately predicting those sewer lines highly susceptible to root intrusion, grease and grit accumulation prior to servicing such sewer lines. The prediction method described herein was tested on a two square mile area of sewer lines in Tucson, Ariz., and those predictions proved 100% accurate. Accurately predicting those sewer lines most highly susceptible to blockages provides a basis for efficient sewer line maintenance. Hence, stoppages, over-flows and line damage can be prevented. Consequently, those sewer lines not needing service are also identified (the vast majority of sewer lines) and substantial resources are saved by avoiding needless preventive maintenance.

The preventive sewer line maintenance involves both accurate prediction techniques combined with a systematic coverage of an entire sewer system. Service for roots, grease and grit are performed systematically, for example, one square mile (or grid) at a time until the entire system is serviced. When completed, and depending upon the size of the area and the number of crews, the service is repeated starting over at the first one square mile. Generally, potential grease lines are serviced quarterly to annually, and each potential root intrusion is serviced bi-annually to annually, depending upon the extent of the intrusion.

Root Prediction and Service

Figure 3:
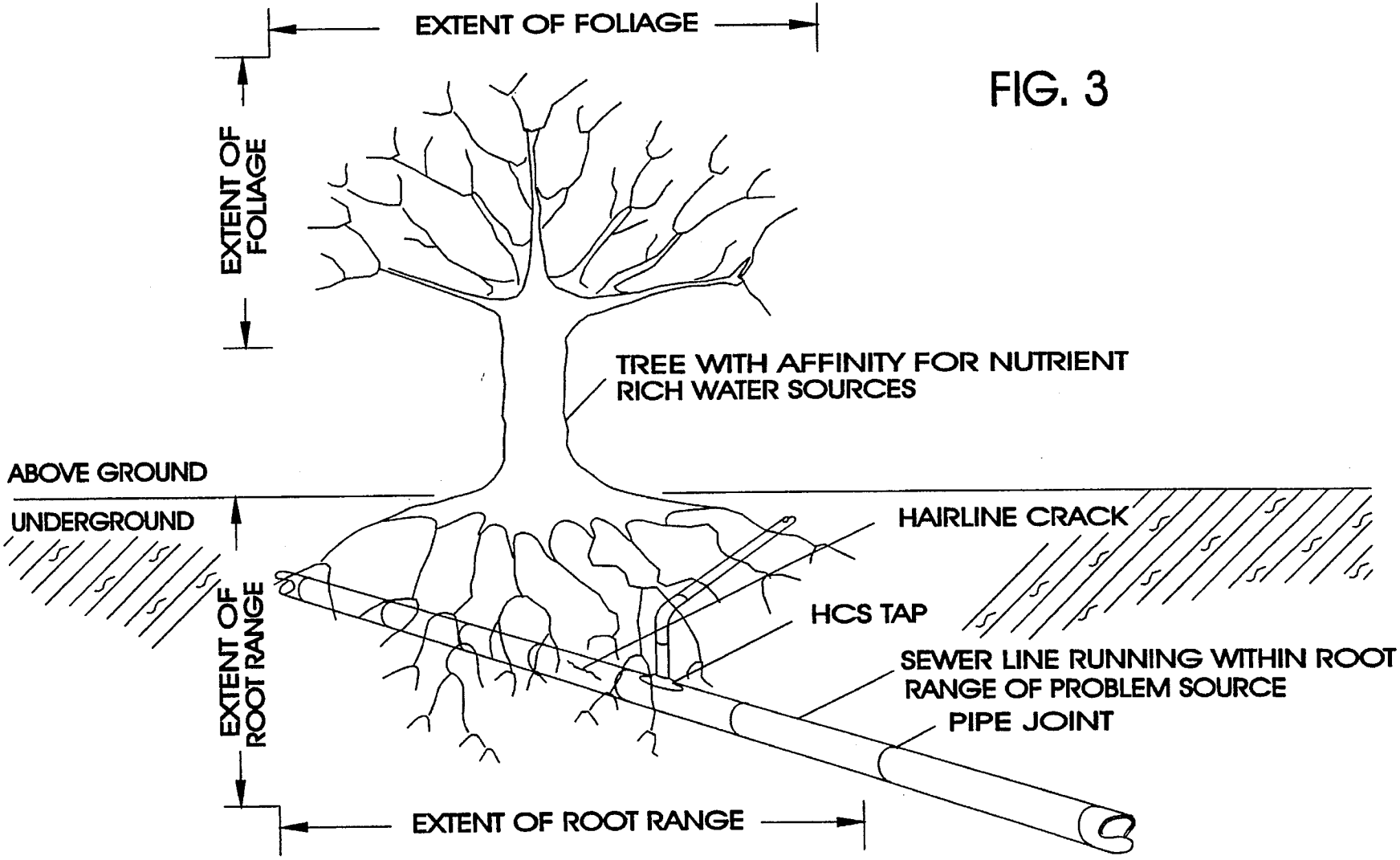
FIG. 3 is a pictorial diagram depicting root intrusion in a sewer line in accordance with a preferred embodiment of the present invention.

FIG. 3 depicts an example of root intrusion, wherein certain foliage having an affinity for nutrient rich water sources is located above or near a sewer line. In this example, the root range underground generally extends a distance substantially equal to the range of the foliage above ground. In the Southwest, for example, three types of vegetation commonly cause root intrusion into sewer lines: (1) eucalyptus trees; (2) tamarack trees; and (3) oleander bushes. These plants are able to seek out and infiltrate sewer lines, in search of the nutrient rich water. As would be expected, in other parts of the country, other plants (having affinities for nutrient rich water sources) would be the main causes root intrusion.

Having identified those plants, for a given locality, that seek nutrient rich water sources (and having roots able to infiltrate sewer lines), the next step to preventing root intrusion damage to sewer lines includes identifying those locations where the predetermined plant types are growing in proximity to known sewer line locations, and taking measurements to determine what portion of the sewer line needs to be serviced. Only the portion of a line which runs within the root range of the identified plants needs to be serviced.

As an example, assume that a eucalyptus tree is observed seventy-five feet from an accessible manhole and is growing directly over a sewer line. The foliage extends twenty-five feet to either side of the tree trunk. The segment of sewer line to be rodded would be from the manhole, through the root range, plus a predetermined additional distance as a safety margin, for example, an additional twenty-five feet. Hence, a 125 foot distance from the manhole would be rodded (75 feet+25 feet+25 feet). The remaining 225 feet of an average sewer line section (350 feet total) does not need to be serviced.

The average distance rodded to remove roots is 137.5 feet. This is calculated by dividing the average sewer line segment by two (an obstruction can be accessed from either an upstream or downstream manhole) which equals 175 feet, or the distance to the center of the sewer line. The average of 175 feet is 87.5 feet to which 25 feet of foliage extension and a safety margin of 25 feet is added for a total of 137.5 feet. Currently, within Pima County, in Arizona, each crew is expected to service between 2,000 and 3,000 feet of sewer line per day. When this quota is met by ridding full sewer line segments (as currently required) six to eight sewer line segments can be serviced daily by each crew. Unfortunately, typically only five to ten percent of such lines actually need service (no attempt at predictions is made). Using Pima County's daily footage quota, using the method described herein, 14.5 to 22 sewer lines could be serviced by each crew each day. Not only would more lines be serviced, but every line serviced would have a very high probability of actually needing service.

After each sewer line is serviced, the footage rodded and severity of the problem encountered are entered on a Grid System Log (See FIG. 5). All lines with root probability are serviced annually, intercepting new growth within the annual growth cycle. Sewer lines with extensive root growth are serviced twice annually.

Grease Prediction and Service

State and local ordinances usually prohibit dumping grease and require establishments that produce large amounts of grease to install grease traps, or other devices to prevent the grease from entering the sewage system. In spite of this, grease problems still occur. The location of sewer line grease problems are almost exclusively the sewer lines downstream from restaurants and cafeterias. Obviously, regulations concerning grease dumping need to be more closely enforced. In addition to this, sewer lines downstream from restaurants and cafeterias should be cleared.

High pressure cleaners are the best equipment for servicing grease impeded sewer lines. Due to commercial zoning, HPC crews will have limited areas to inspect. Inspection and service is done as crews move systematically through commercial areas. The sewer line section immediately downstream from problem businesses is flushed from downstream to upstream and from manhole/clean-out to manhole/clean-out. Flushing continues through each subsequent section until no more grease is encountered. Documentation is made on the Grid System Log. Service of these potential problem sewer lines is done every three to six months, depending upon the amount of grease encountered.

Grit Prediction and Service

An indicator for grit accumulation in a sewer line is low scouring velocity (slow flow of sewage, due to insufficient grade descent of the sewer line). The scouring velocity is determined using sewer line blueprints. The blueprints indicate an elevation of each manhole base. With these elevations, scouring velocity can be calculated. Any sewer line with less than a predetermined velocity, for example, 2.5 feet per second, would be slated for service. Although grit accumulation can hinder the flow of sewage, it rarely causes a stoppage. Grit lines, therefore, only need to be serviced once every five to ten years.

METHOD OF THE INVENTION

Referring again to FIG. 5, a grid system maintenance log is shown wherein twenty-five sewer line service locations can be logged on a single page. Using the grid system maintenance log greatly decreases an amount of paper work currently required. For example, a "clean all lines" work order typically allows recording only six to eight sewer line locations per page (usually one days work is entered). The WCMS work order allows only one sewer line location per page. Likewise, a "false alarm" work order allows for only one sewer line location per page.

The method according to a preferred embodiment of the invention is shown in flow diagram form in FIGS. 4A and 4B. The process starts at a step 401 wherein a sewer line system is to be maintained. At step 403, those sewer lines containing root intrusion, grease and/or grit accumulation are to be rodded or flushed accordingly. Step 405 indicates that only those sewer lines which actually require service will have preventive maintenance performed thereon. Stated in the alternative, those sewer lines free of blockages will not be serviced. Step 407 involves systematically identifying those sewer lines having a high probability of requiring service. This can be accomplished methodically by assigning crews to work one square mile areas, or grids, at a time. Using blueprints or other suitable maps of the area, the external forces that adversely act upon sewer lines, proximate to those sewer lines are, are surveyed. Step 409 directs a different method of service depending upon whether the external forces suggest root, grease or grit accumulation is suspected.

Servicing sewer lines for root intrusion, at step 411, is based upon identifying predetermined plant types (common to a given geographical area) that exhibit predetermined growth patterns. For example, those plants having root systems with an ability to find and penetrate sewer lines, and are growing near sewer lines, with foliage indicating root lengths capable of reaching such proximate sewer lines, would be strong prediction indicators that sewer lines therebelow are in need of preventive maintenance service. As stated above, in Pima county, for example, such foliage that provide strong prediction indicators include Eucalyptus, Tamarack and Oleanders.

Hence, crews follow sewer line maps for a given grid and survey for the predetermined foliage. Having identified such foliage, step 413 requires determining the distance from the foliage to the sewer line. At step 414, if it is determined that the sewer line is within range of the root range of the foliage, then the sewer line will be serviced. At step 415 the specific type of service is determined, that is, the method and equipment for cleaning as well as the section of the sewer line to clean.

Referring to FIG. 4B, additional details are given in steps 417–441 for steps 414 and 415. At step 417, a sewer system is maintained by systematically inspecting and servicing sewer lines, one grid at a time, in established populated areas (higher priority due to higher probability of blockages), and then on to rural areas. Depending upon the number of crews, populated and rural areas may be serviced in parallel. Step 419 includes inspecting for problem vegetation within each grid. Step 421 requires logging the existence of problem vegetation in a grid system log (FIG. 5). In step 423, using a footage counter or measuring gauge (not shown) as is well known, a distance is measured from the nearest manhole/clean-out to the problem vegetation above the sewer line. The sewer line is then serviced, for example, by rodding from the nearest manhole/clean-out to the distance just measured plus an additional safety margin distance, for example, 25 feet, in order to rod through the root range.

Step 427 determines whether roots were actually found, that is, whether the vegetation/root range/sewer line proximity was an accurate predictor. If not, then an appropriate indication is made in the grid system log so that a knowledge based data base can be maintained and follow-up service can be performed accordingly, for example, annually. If roots were found, then step 429 determines the extent of the root intrusion. Heavy root intrusion is logged in the grid system log at step 433 for indicating re-service within, for example, six months. If light root intrusion is found, then at step 433 the finding is logged and re-service is scheduled, for example, annually.

After performing step 431, 433 or 435, the process returns to step 421 to continue surveying the remainder of the grid. When a grid is completed then control goes to step 439 to service a next grid. This process continues until all grids are serviced at step 441. Having serviced all grids, the process repeats with those areas know to require service being serviced according to the grid system log.

Referring back to FIG. 4A, if at step 409, it is determined that grease blockage preventive maintenance will be performed, then predictors indicating grease generators are determined at step 451, for example, restaurants and cafeterias. At step 453 the appropriate method of performing preventive maintenance for potentially grease blocked sewer lines is determined. Step 455 identifies the method as systematically inspecting, on a grid basis, for example, a square mile per grid, first commercial and then residential areas for the grease producers. Having determined that predetermined grease producers will be located at step 457, then at step 459 it is determined what method of locating those predetermined grease producers will be used.

At step 461, the grease producers are located by searching main streets, commercially zoned areas, and using street maps. In FIG. 4B at step 463, the addresses of located grease producers are logged, and a distance is measured from a first downstream manhole/clean-out through the grease producer property. The proper equipment, for example, HPCs, is used to flush the sewer line at step 465. Step 469 determines whether any grease was in the predicted sewer line. If no grease was found, at step 473, a log entry is made indicating annual servicing and control goes to step 463 to locate other grease producers in the grid. If grease was found, then step 471 is performed to determine the magnitude of the grease. If substantial grease is found, then at step 475 a log entry is made to re-service the sewer line every three months. If only a minor amount of grease is found, then at step 477 a log entry is made for re-servicing the line every six months.

If any grease was found, then following step 475 or step 477, step 479 is performed wherein the servicing equipment is set up at the next downstream manhole/clean-out. Steps 465–479 are repeated until the grease is removed. Step 481 includes repeating the process through each grid until the entire system is serviced. Root intrusions, and grease and grit accumulations can be located and serviced by the same crew or by different crews.

A knowledge based preventive maintenance system is created by building a database from the log entries. Such a database can be realized using commercially available spreadsheet of database programs. The knowledge based system can be run on a personal computer, workstation, etc., depending upon the size of the database. Such a database will have knowledge of every sewer line serviced in the area and the extent of the blockage found at each serviced sewer line. The knowledge based system can be used to measure accuracy of the predictions, thereby testing the accuracy of the predictors used. Additionally, such knowledge based system can generate daily/weekly work orders identifying those sewer lines requiring regular maintenance. Still further, sewer line blockage locations and the degree of blockage found thereat can be entered directly into a portable computer or into a communication device for transmitting such information to a central office.

The invention as described herein, departs from a typical sewer line maintenance management strategy of attaining daily sewer line footage goals irrespective of cost effectiveness. That sewer line footage goal is typically between 2,000 and 3,000 feet rodded per day. In order to achieve such a goal, crews are expected to rod from manhole/clean-out to manhole/clean-out. The average distance between consecutive manhole/clean-outs is approximately 350 feet. Using the sewer line maintenance system described herein, the average distance per rodded sewer line would be approximately 150 feet. Rodding is not performed for footage quotas. Rodding is used efficiently, based upon knowledge applied to the sewer lines and the surrounding environment. Thus, clear sewer lines are not serviced, and blocked or those sewer lines having a high probability of becoming blocked are rodded. Known problematic sewer lines are regularly serviced. Hence, manpower, time, equipment life, gasoline, etc. are intelligently used.

In summary, the preventive maintenance sewer line system according to the preferred embodiment of the present invention is potentially 35 times more cost effective than current maintenance systems. Knowledge based sewer line maintenance (based upon sewer line maintenance principles, hydrology, and plant root behavior) provides anticipation and interception of sewer line problems in place of emergency intervention. Hence, sewer line problems are corrected prior to any interference in service. In addition, permanent damage to sewer lines can be drastically reduced. Sewage contamination requiring clean-up, litigation and repair of damaged sewer lines and property will also be decreased. The result is savings to the agencies responsible.

While the invention has been particularly shown and described with reference to preferred embodiments thereof, it will be understood by those skilled in the art that various changes in form and details may be made therein without departing from the spirit and scope of the invention. The particular described herein may vary without departing from the invention set forth. Similarly, the particular form of the plants causing root intrusion will vary depending upon geographical locality.

What is claimed is:

1. A method of providing preventive maintenance service to sewer lines in a given locality by servicing only those sewer lines having a substantial probability of near term blockages, said method comprising steps of:

(a) dividing said given locality into a plurality of predetermined areas;

(b) identifying blockage predictors including foliage common to said given locality known to cause root intrusion and using said foliage as root intrusion predictors and further including properties capable to generate substantial amounts of grease and using such properties as grease predictors;

(c) surveying a first predetermined area and identifying root intrusion predictors proximate to sewer lines and grease predictors proximate to sewer lines;

(d) cleaning those sewer lines proximate to said identified root intrusion predictors from a nearest manhole/clean-out to a safety margin distance beyond an edge of identified root intrusion predictor's roots, and cleaning those sewer lines proximate to said grease predictors starting at a nearest downstream manhole/clean-out;

(e) logging a location and degree of blockage for each root intrusion and grease blockage on a log form;

(f) entering logged sewer line blockages into a database thereby forming a knowledge based sewer line service system;

(g) re-cleaning sewer line locations on a predetermined schedule according to the knowledge based sewer line service system based upon a degree of blockage found at the sewer line locations; and (h) repeating steps (a)–(g) for each predetermined area until all predetermined areas are serviced.

2. The method according to claim 1 wherein sewer lines predicted to be blocked by root intrusion in step (d) are cleaned by rodding the respective sewer line segments.

3. The method according to claim 1 wherein sewer lines predicted to be blocked by grease in step (d) are cleaned by a high pressure cleaner.

4. The method according to claim 1 further comprising a step (i) of identifying sewer lines having a substantial probability of being partially blocked by grit by inspecting sewer line plots for those sewer lines having a slope less than a predetermined downward slope.

5. The method according to claim 4 wherein identified grit blocked sewer lines are serviced by high pressure cleaning the sewer line from a nearest downstream manhole/clean-out.

6. The method according to claim 1 wherein said safety margin of step (d) is approximately 25 feet.

7. The method according to claim 1 wherein said root intrusion predictors are those foliage for said given area having water seeking roots capable to penetrate a sewer line.

8. The method according to claim 7 wherein said root intrusion predictors include Tamaracks, Oleanders and Eucalyptus.

9. The method according to claim 1 wherein said grease predictors include restaurants and cafeterias.

10. The method according to claim 1 wherein predetermined areas located in residential and commercial areas are serviced prior to predetermined areas located in rural areas.

11. A sewer line preventive maintenance method for regularly servicing sewer lines in a given geographical area, said preventative maintenance method comprising steps of:

(a) determining, for said geographical area, sewer line blockage predictors;

(b) dividing said geographical area into a plurality of predetermined grids;

(c) identifying probable sewer line blockages in each grid by using said sewer line blockage predictors;

(d) cleaning sewer lines in each grid having a sewer line blockage predictor proximate thereto; and (e) building a knowledge based preventative maintenance database for regularly cleaning the identified probable sewer line blockages in said given geographical area.

12. The preventive maintenance method according to claim 11 wherein said sewer line blockage predictors in step (a) include foliage common to said geographical area having roots capable of intruding sewer lines seeking mineral rich water and further including grease generating properties.

13. The preventive maintenance method according to claim 12 wherein sewer lines cleaned for root blockage are cleaned from a distance from a nearest manhole/clean-out to a predicted end of roots causing the root blockage plus a safety distance therebeyond.

14. The preventive maintenance method according to claim 13 wherein sewer lines determined to be blocked be grease are cleaned by using a high pressure cleaner from a nearest down sewer line manhole/clean-out.

15. The preventive maintenance method according to claim 14 wherein those sewer lines found to have a blockage are scheduled for re-clean on a regular predetermined basis according to a degree of blockage found.

16. The preventive maintenance method according to claim 15 wherein the knowledge based preventive maintenance database tracks an accuracy of sewer line blockage predictions by comparing predicted blockage to actual blockages.

17. The preventive maintenance method according to claim 16 wherein the knowledge based preventive maintenance database schedules re-clean of sewer lines according to grid locations.

18. A method of systematically providing preventive maintenance service to sewer lines in a geographical area by identifying those sewer lines having a substantial probability of having near term blockages, said method comprising steps of:

(a) dividing said geographical area into a plurality of grids;

(b) identifying blockage predictors including foliage common to said geographical area known to cause root intrusion and using said foliage as root intrusion predictors and further including properties capable to generate substantial amounts of grease and using such properties as grease predictors;

(c) surveying a first predetermined area for identifying root intrusion predictors proximate to sewer lines and grease predictors proximate to sewer lines;

(d) cleaning those sewer lines proximate to said identified root intrusion predictors from a nearest manhole/clean-out to a safety margin distance beyond an edge of identified root intrusion predictor's roots, and cleaning those sewer lines proximate to said grease predictors starting at a nearest downstream manhole/clean-out;

(e) entering a location and degree of blockage for each root intrusion and grease blockage directly into a communicating device;

(f) receiving the entered sewer line blockages into a database thereby forming a knowledge based sewer line service system;

(g) re-cleaning sewer line locations on a predetermined schedule according to the knowledge based sewer line service system based upon a degree of blockage found at the sewer line locations; and (h) repeating steps (a)–(g) for each predetermined area until all predetermined areas are cleaned.

19. The method according to claim 18 wherein said root intrusion predictors are those foliage for said given area having water seeking roots capable to penetrate a sewer line.

20. The method according to claim 19 wherein sewer lines not identified in step (c) are not cleaned unless there is an actual known blockage.

* * * * *